US005525458A

United States Patent [19]

Takizawa

[11] Patent Number: 5,525,458

[45] Date of Patent: Jun. 11, 1996

[54] DESENSITIZING SOLUTION FOR LITHOGRAPHIC PLATEMAKING

[75] Inventor: Tsuyoshi Takizawa, Shizuoka, Japan

[73] Assignee: Tomoegawa Paper Co., Ltd., Tokyo, Japan

[21] Appl. No.: 299,644

[22] Filed: Sep. 2, 1994

[30] Foreign Application Priority Data

| | | | |
|---|---|---|---|
| Sep. 2, 1993 | [JP] | Japan | 5-240302 |
| Nov. 16, 1993 | [JP] | Japan | 5-309799 |

[51] Int. Cl.[6] ..... G03C 5/00

[52] U.S. Cl. ..... 430/331; 430/302; 430/309; 101/450.1; 101/451; 101/466; 106/2

[58] Field of Search ..... 430/331, 309, 430/302; 101/450.1, 451, 466; 106/2

[56] References Cited

U.S. PATENT DOCUMENTS

| | | | |
|---|---|---|---|
| 3,617,266 | 11/1971 | Williams et al. | 101/451 |
| 4,579,591 | 4/1986 | Suzuki et al. | 430/331 |

FOREIGN PATENT DOCUMENTS

| | | |
|---|---|---|
| 0135031 | 3/1985 | European Pat. Off. . |
| 0526191 | 2/1993 | European Pat. Off. . |
| 1558045 | 2/1969 | France . |
| 56-2189 | 1/1981 | Japan . |
| 57-107889 | 7/1982 | Japan . |
| 1162135 | 8/1969 | United Kingdom . |

OTHER PUBLICATIONS

European Search Report dated Jan. 13, 1995.

*Primary Examiner*—Marion E. McCamish
*Assistant Examiner*—Laura Weiner
*Attorney, Agent, or Firm*—Cushman Darby & Cushman

[57] ABSTRACT

A desensitizing solution for lithographic platemaking which mainly comprises phytic acid or a salt thereof is disclosed, said desensitizing solution containing a polyether polyamine or a derivative thereof represented by formula (I):

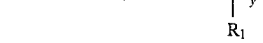

(I)

wherein k, m, x, and y each represent an integer of 1 or more; and $R_1$ represents a hydrogen atom or $C_nH_{2n}R_2$, wherein n is an integer of 1 or more, and $R_2$ represents a hydrogen atom, an $NR_3R_4$ (wherein $R_3$ and $R_4$ each represent a hydrogen atom or an alkyl group), a chlorine atom, a fluorine atom, an iodine atom, a bromine atom, a hydroxyl group, a carboxyl group or a carbamoyl group, or a polyamine derivative represented by formula (II):

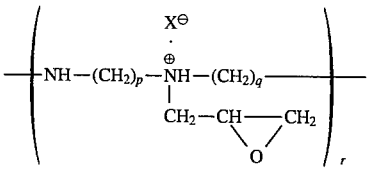

(II)

wherein X represents a halogen atom; p and each represent an integer of from 2 to 6; and r represents an integer of from 3 to 2000. The desensitizing solution exhibits satisfactory desensitizing characteristics without causing environmental pollution.

14 Claims, No Drawings

DESENSITIZING SOLUTION FOR LITHOGRAPHIC PLATEMAKING

FIELD OF THE INVENTION

This invention relates to a desensitizing solution for lithographic platemaking. More particularly, it relates to a desensitizing solution which is used in manufacturing printing plates, such as an electrophotographic lithographic plate, a silver salt plate, and a presensitized plate called a PS plate.

BACKGROUND OF THE INVENTION

Lithographic printing, i.e., offset printing is a printing method comprising applying a desensitizing solution on a printing plate precursor having thereon an image area comprising an ink-receptive lipophilic layer and a non-image area to thereby form a hydrophilic layer on the non-image area, applying an oily ink to the lipophilic image area, and transferring the ink on the image area to paper.

Of the printing plate precursors, an electrophotographic lithographic plate precursor comprising a support, such as paper, having provided thereon a photosensitive layer comprising a photoconductive powder, such as zinc oxide, dispersed in a binder resin is produced by forming an image by an electrophotographic technique. That is, the photosensitive layer is charged, imagewise exposed to light, and developed with a developing solution containing lipophilic toner particles to form an image area. A desensitizing solution is then applied whereby the desensitizer in the desensitizing solution and the photoconductive powder on the surface form a hydrophilic substance which forms a hydrophilic non-image area. The thus prepared lithographic printing plate comprising a lipophilic area and a hydrophilic area is mounted on a printing machine.

The main components of conventional desensitizing solutions are roughly divided into cyan substances and non-cyan substances.

Cyan substances, which contain a cyanide ion in the molecule thereof as an inorganic complex, include ferrocyanides and ferricyanides. These substances exhibit powerful desensitizing ability and provide printing plates satisfying printing characteristics as a whole. Labile to light or heat, however, the cyan substances easily undergo discoloration or sedimentation or reduce their desensitizing ability with time. Further, the cyan substances themselves are stable and harmless to human bodies but are decomposed under various environmental conditions, such as irradiation of ultraviolet rays or a radiation, to release harmful cyanide ions, which may cause environmental problem. Furthermore, where a plate produced by using a cyan substance-based desensitizing solution is used for printing on neutral paper or printing with quick-drying color inks, such unfavorable phenomena as stains on prints and emulsification of inks tend to occur.

The non-cyan substances, on the other hand, include phytic acid or a salt thereof and, in addition, inorganic salts. Although phytic acid or a salt thereof is excellent in environmental safety and workability, it has weak desensitizing ability so that conditions of printing are difficult to set and the prints are liable to staining. In order to overcome these disadvantages of phytic acid, a combined use with a metal complex of an aminocarboxylic acid (see JP-B-2-39397, the term "JP-B" as used herein means an "examined published Japanese patent application") and a combined use of a hexametaphosphoric acid salt (see JP-B-62-7597) have been suggested. However, satisfactory effects have not been obtained yet.

SUMMARY OF THE INVENTION

An object of the present invention is to provide a desensitizing solution for lithographic platemaking, which exhibits satisfactory desensitizing ability without causing any environmental problem.

The present invention relates to a desensitizing solution for lithographic platemaking, mainly comprising phytic acid or a salt thereof, the desensitizing solution containing a polyether polyamine or a derivative thereof represented by formula (I):

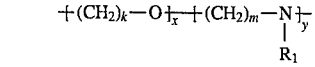

(I)

wherein k, m, x, and y each represent an integer of 1 or more; and $R_1$ represents a hydrogen atom or $C_nH_{2n}R_2$, wherein n is an integer of 1 or more, and $R_2$ represents a hydrogen atom, an $NR_3R_4$ (wherein $R_3$ and $R_4$ each represent a hydrogen atom or an alkyl group), a chlorine atom, a fluorine atom, an iodine atom, a bromine atom, a hydroxyl group (—OH), a carboxyl group (—COOH) or a carbamoyl group (—$CONH_2$), or a polyamine derivative represented by formula (II):

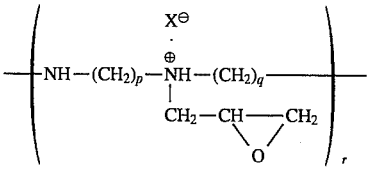

(II)

wherein X represents a halogen atom; p and q each represent an integer of from 2 to 6; and r represents an integer of from 3 to 2000.

DETAILED DESCRIPTION OF THE INVENTION

The polyether polyamines or derivatives thereof represented by formula (I) and the polyamine derivatives represented by formula (II) are both highly cationic compounds, which react with phytic acid or a salt thereof to bring about a great improvement in desensitizing ability. Of the polyether polyamines or derivatives thereof of formula (I) and the polyamine derivative of formula (II), those having a colloid equivalent value, as a measure of cationic force, of not lower than 3 at a pH between 3 and 10 are preferred, since they have satisfactory reactivity with phytic acid or a salt thereof to provide more excellent desensitizing ability.

Quaternized polyether polyamines, in which part or all of the nitrogen atoms contained in the polyether polyamine or a derivative thereof of formula (I) are quaternized as shown in the following structure, are also employable as such a cationic compound.

$$+(CH_2)_m-\overset{X^-}{\underset{R_1}{N^+H}}\Big]_y$$

$X^-$: counter anion (e.g., a halogen atom)

The term "colloid equivalent value" as used herein means one described in Senju Ryouichi, "Colloid Titration Method", pages 3 to 6, issued by Nankoudou, Japan. The large the value is, the larger the cationic property.

In formula (I), it is preferred that k is an integer of from 1 to 60, m is an integer of 1 to 12, x is an integer of 1 to 5, y is an integer of 1 to 10 and n is an integer of 1 to 20. $C_nH2nR_2$ as $R_1$ is preferably those having 1 to 8 carbon atoms.

The polyether polyamines or derivatives thereof of formula (I) must be water-soluble, i.e., thoroughly dissolved in the desensitizing solution.- For obtaining the polyether polyamines or derivatives thereof having good water-solubility, it is preferable that k is from 2 to 50 and m is from 1 to 10. It is preferable for accomplishing excellent desensitizing characteristics that an x to y ratio (x:y) is from 1:1 to 4:1. The polyether polyamines or derivatives thereof of formula (I) preferably have a number average molecular weight of from 100 to 1,000,000, still preferably from 1,000 to 1,000,000.

The polyether polyamines or derivatives thereof of formula (I) can be prepared by mixing an ether and an amine, and stirring the mixture at 50° to 100° C. for 4 hours or more under a nitrogen stream.

The polyamine derivatives of formula (II) are polymers having a quaternary amino group.

The polyamine derivatives of formula (II) are water-soluble compounds obtained by copolymerization of an epoxy-containing compound, such as epichlorohydrin, and an alkyleneimine. Of the polyamine derivatives (II), those obtained by copolymerizing a lower alkylene-imine and epichlorohydrin, especially those of formula (II) wherein p and q are each 2 to 3 and X is a chlorine atom are preferred, since they exhibit satisfactory water-solubility and satisfactory reactivity with phytic acid or a salt thereof to achieve excellent desensitizing characteristics. The polyamine derivatives of formula (II) preferably have a number average molecular weight of from about 1000 to 1,000,000, still preferably from 50,000 to 1,000,000.

Water can be used as a solvent for the desensitizing solution according to the present invention.

Phytic acid which can be used in the present invention is also called inositol hexaphosphate. Conventionally employed phytic acid and salts thereof may be used in the present invention. In an acidic solution, these compounds form a salt with a metal and serve as a desensitizing agent. The phytic acid salts which can be used in the present invention include an alkaline metal salt, an alkaline earth metal salt, an ammonium salt, and an amine salt.

The desensitizing solution according to the present invention contains phytic acid or a salt thereof generally in a concentration ranging from 1 to 200 g/l and the polyether polyamine or a derivative thereof of formula (I) or the polyamine derivative of formula (II) generally in a concentration of from 0.01 to 20 g/l, preferably from 0.1 to 5.0 g/l.

In the case of using the desensitizing solution according to the present invention as a damping solution, the concentration of phytic acid or a salt thereof of the damping solution is generally from 3 to 100 g/l, preferably from 3 to 50 g/l.

The pH of the desensitizing solution according to the present invention is preferably approximately from 4.0 to 5.0. In the case of a zinc oxide system printing plate, it is preferred that the pH is from 4.0 to 4.6.

Cases are sometimes met with in which phytic acid and the polyether polyamine are bound together, or phytic acid or a salt thereof and the polyamine derivative are bound together, to form a water-insoluble compound. Such being the case, a buffer agent may be added to the desensitizing solution. Examples of suitable buffer agents include ammonium sulfate and sulfonic acid compounds, such as methanesulfonic acid or a salt thereof, ethanesulfonic acid or a salt thereof, benzenesulfonic acid or a salt thereof, toluenesulfonic acid or a salt thereof, and xylenesulfonic acid or a salt thereof.

The desensitizing solution of the present invention may further contain various additives, such as pH adjusting agent or buffers, wetting agents, preservatives, and rust inhibitors.

Suitable pH adjusting agents or buffers include inorganic acids, organic acids, and salts thereof, either individually or in combination thereof. Specific examples of suitable inorganic acids are phosphoric acid, sulfuric acid, hydrochloric acid, and nitric acid. Specific examples of suitable organic acids are formic acid, acetic acid, butyric acid, valeric acid, lactic acid, tartaric acid, propionic acid, oxalic acid, malonic acid, succinic acid, glutaric acid, maleic acid, phthalic acid, citraconic acid, itaconic acid, fumaric acid, tricarballylic acid, glycolic acid, thioglycolic acid, malic acid, citric acid, gluconic acid, pyruvic acid, salicylic acid, adipic acid, hydracrylic acid, glyceric acid, and p-toluenesulfonic acid. Salts of these acids include alkali metal salts, ammonium salts, and amine salts.

Specific examples of suitable wetting agents are ethylene glycol, diethylene glycol, triethylene glycol, polyethylene glycol, glycerol, gum arabic, carboxymethyl cellulose, acrylic polymers, methanol, ethanol, isopropyl alcohol, n-propyl alcohol, and triethanolamine.

Specific examples of preservatives are salicylic acid, phenol, butyl p-phenolbenzoate, sodium dehydroacetate, and 4-isothiazol- 3-one compounds.

Specific examples of rust inhibitors include ethylenediaminetetraacetic acid (EDTA), sodium nitrite, and dicyclohexylammonium nitrite.

The present invention will now be illustrated in greater detail with reference to Examples, but it should be understood that the present invention is not construed as being limited thereto. All the percents and parts are by weight unless otherwise indicated.

EXAMPLE 1

| | |
|---|---|
| Phytic acid | 50 parts |
| Polyether polyamine $(-(CH_2-CH_2-O)_x-(CH_2-CH_2-NH)_y-$; number | 1 part |

-continued

| | |
|---|---|
| average molecular weight: 10,000; x:y = 2:1)) | |
| Distilled water | 1000 parts |

The above components were thoroughly mixed to dissolve. About 40 parts of a 50% aqueous ammonia solution was added thereto to adjust to pH 4.0 to prepare a desensitizing solution of the present invention.

EXAMPLE 2

| | |
|---|---|
| Phytic acid | 100 parts |
| Polyether polyamine ($(-((CH_2)_3-O)_x-(CH_2-CH_2-N(CH_2CH_2NH_2))_y-$; number average molecular weight: 10,000; x:y = 2:1) | 5 parts |
| Ammonium sulfate | 54 parts |
| Distilled water | 1000 parts |

The above components were thoroughly mixed to dissolve. About 40 parts of a 50% aqueous ammonia solution was added thereto to adjust to pH 4.0 to prepare a desensitizing solution of the present invention.

EXAMPLE 3

A desensitizing solution according to the present invention was prepared in the same manner as in Example 1, except for using a polyether polyamine having a structural formula of $-((CH_2)_{12}-O)_x-(CH_2-CH_2-NH)_y-$ (number average molecular weight: 100,000; x:y=2:1).

EXAMPLE 4

A desensitizing solution according to the present invention was prepared in the same manner as in Example 1, except for using a polyether polyamine having a structural formula of $-((CH_2)_{18}-O)_x-(CH_2-CH_2-NH)_y-$ (number average molecular weight: 500,000; x:y=4:1).

EXAMPLE 5

A desensitizing solution according to the present invention was prepared in the same manner as in Example 1, except for using a polyether polyamine having a structural formula of $-((CH_2)_{28}-O)_x-(CH_2-CH_2-NH)_y-$ (number average molecular weight: 1,000,000; x:y=4:1).

COMPARATIVE EXAMPLES 1 TO 4

Components shown in Table 1 (unit: part by weight) below were thoroughly mixed to dissolve, and about 40 parts of a 50% aqueous ammonia solution was added thereto to adjust to pH 4.0 to prepare a comparative desensitizing solution.

TABLE 1

| | Compara. Example 1 | Compara. Example 2 | Compara. Example 3 | Compara. Example 4 |
|---|---|---|---|---|
| Phytic acid | 50 | | 50 | 50 |
| Sodium ferrocyanide | | 20 | | |
| Polyethylene oxide | | | 1 | |
| Polyethyleneimine[1)] | | | | 1 |
| Sodium primary phosphate | | 75 | | |
| Distilled water | 1000 | 1000 | 1000 | 1000 |

Note
[1)]number average molecular weight: 10,000

EXAMPLES 6 TO 10

The components shown in Table 2 (unit: part by weight) below were thoroughly mixed to dissolve, and a 50% aqueous ammonia solution was added thereto to adjust to pH 4.0 to prepare a desensitizing solution according to the present invention.

TABLE 2

| | Example 6 | Example 7 | Example 8 | Example 9 | Example 10 |
|---|---|---|---|---|---|
| Phytic acid | 150 | | | 150 | 50 |
| Ammonium phytate | | 150 | | | |
| Magnesium phytate | | | 150 | | |
| Polyethyleneimine epichlorohydrin[2)] | 1 | 1 | 1 | | 0.1 |
| Polypropyleneimine epichlorohydrin[3)] | | | | 1 | |
| Ammonium sulfate | 54 | 54 | 54 | 54 | 27 |
| Toluenesulfonic acid | 19 | 19 | 19 | 19 | 9 |
| Distilled water | 1000 | 1000 | 1000 | 1000 | 1000 |

Note[2)]

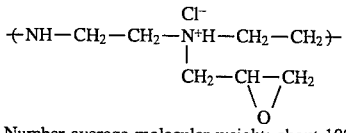

Number average molecular weight: about 100,000

Note[3)]

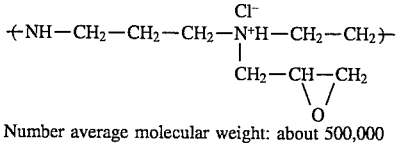

Number average molecular weight: about 500,000

COMPARATIVE EXAMPLES 5 TO 7

The components shown in Table 3 (unit: part by weight) below were thoroughly mixed to dissolve, and a 50% aqueous ammonia solution was added thereto to adjust to pH 4.0 to prepare a comparative desensitizing solution.

TABLE 3

| | Compara. Example 5 | Compara. Example 6 | Compara. Example 7 |
|---|---|---|---|
| Phytic acid | 150 | | |
| Ammonium phytate | | 150 | |
| Magnesium phytate | | | 150 |
| Distilled water | 1000 | 1000 | 1000 |

A commercially available electrophotographic lithographic printing plate precursor having a zinc oxide/resin dispersion photosensitive layer was electrophotographically processed in a usual manner to form an image area and etched with each of the desensitizing solutions prepared in Examples 1 to 10 and Comparative Examples 1 to 7 by means of an automatic etching machine manufactured by Ricoh Co., Ltd. to obtain an offset printing plate.

A damping solution, the same desensitizing solution as used for etching 5-fold diluted with water, was fed to a Dahlgren dampening system lithographic printing machine manufactured by Ryobi Ltd., and printing on neutral paper "TOMOERIVER" produced by Tomoegawa Paper Co., Ltd. was continuously carried on using a quick-drying color ink "F Gloss Gunjo" produced by Dainippon Ink & Chemicals, Inc.

The 3000th print was observed to evaluate ink receptivity, resolving power, scumming, and reproducibility of dots according to the following standard. Further, the inking roller after obtaining 3000 prints was observed to see if emulsification of the printing ink or roller stripping occurred, and the results of observation were rated as follows. The results obtained are shown in Tables 4 and 5 below.

1) Ink Receptivity:

A sample print whose solid image area had a density of not less than 1.0 was rated "good", and others were rated "bad", the image density being measured with a Macbeth densitometer RD-914.

2) Resolving Power:

The resolution of a sample print for a test chart in each of the longitudinal and transverse directions was evaluated with the naked eye with the aid of a magnifier. The resolving power was expressed in terms of the number of reproduced rulings per mm width. The larger the ruling number the higher the resolving power.

3) Scumming:

Stains with ink on the background (non-image area) of a sample print were observed with the naked eye and rated as follows.

Good . . . No stains
Medium . . . Slight stains
Bad . . . Considerable stains

4) Reproducibility:

Reproducibility of a dot image of a test chart having a halftone dot area of 80% was observed under a magnifier and rated "good" or "bad".

5) Emulsification:

The inking roller of the printing machine was observed with the naked eye to see if abnormal emulsification occurred. The standard of evaluation is as follows.

Good . . . No occurrence
Medium . . . slight occurrence
Bad . . . Considerable occurrence 6) Roller Stripping:

The inking roller of the printing machine was observed with the naked eye to see if ink stripping occurred. The standard of evaluation is as follows.

Good . . . No occurrence
Bad . . . Occurrence

TABLE 4

| Example No. | Ink Receptivity | Resolving Power Longitudinal | Resolving Power Transverse | Scumming | Reproducibility | Emulsification | Roller Stripping |
|---|---|---|---|---|---|---|---|
| Example 1 | good | 11 | 11 | good | good | good | good |
| Example 2 | good | 11 | 11 | good | good | good | good |
| Example 3 | good | 11 | 11 | good | good | good | good |
| Example 4 | good | 11 | 11 | good | good | good | good |
| Example 5 | good | 11 | 11 | good | good | good | good |
| Comparative Example 1 | bad | 9 | 10 | bad | bad | bad | bad |
| Comparative Example 2 | bad | 10 | 10 | medium | good | medium | good |
| Comparative Example 3 | bad | 9 | 10 | bad | bad | good | good |
| Comparative Example 4 | bad | 10 | 10 | bad | bad | good | good |

TABLE 5

| Example No. | Ink Receptivity | Resolving Power Longitudinal | Resolving Power Transverse | Scumming | Reproducibility | Emulsification | Roller Stripping |
|---|---|---|---|---|---|---|---|
| Example 6 | good | 11 | 11 | good | good | good | good |
| Example 7 | good | 11 | 11 | good | good | good | good |

TABLE 5-continued

| Example No. | Ink Receptivity | Resolving Power Longitudinal | Resolving Power Transverse | Scumming | Reproducability | Emulsification | Roller Stripping |
|---|---|---|---|---|---|---|---|
| Example 8 | good | 11 | 11 | good | good | good | good |
| Example 9 | good | 11 | 11 | good | good | good | good |
| Example 10 | good | 11 | 11 | good | good | good | good |
| Compara. Example 5 | bad | 9 | 9 | bad | bad | bad | bad |
| Compara. Example 6 | bad | 9 | 9 | bad | bad | bad | bad |
| Compara. Example 7 | bad | 9 | 9 | bad | bad | bad | bad |

As can be seen from the results in Tables 4 and 5, the printing plates prepared by using the desensitizing solution according to the present invention exhibit satisfactory ink receptivity, cause no scumming, and show other satisfactory printing characteristics even in continuously used for obtaining 3000 prints. They induced neither ink emulsification nor ink stripping on the inking roller. To the contrary, all the plates prepared by any of the comparative desensitizing solutions exhibited poor ink receptivity and caused scumming or gave rise to any other serious problem.

As described and demonstrated above, the desensitizing solution in accordance with the present invention exhibits excellent desensitizing ability without giving rise to any environmental pollution. Accordingly, the desensitizing solution provides lithographic plates which have practically satisfactory printing characteristics and provide excellent prints.

While the invention has been described in detail and with reference to specific examples thereof, it will be apparent to one skilled in the art that various changes and modifications can be made therein without departing from the spirit and scope thereof.

What is claimed is:

1. A desensitizing solution for lithographic platemaking, comprising an aqueous solvent:

phytic acid or a salt thereof; and a polyether polyamine represented by the formula:

$$+(CH_2)_k-O+_x-+(CH_2)_m-\underset{\underset{R_1}{|}}{N}+_y \qquad (I)$$

wherein k, m, x, and y each represent an integer of 1 or more; wherein $R_1$ represents a hydrogen atom or $C_nH_{2n}R_2$; wherein n is an integer of 1 or more; wherein $R_2$ represents a hydrogen atom, an $NR_3R_4$ group, a chlorine atom, a fluorine atom, an iodine atom, a bromine atom, a hydroxyl group, a carboxyl group, or a carbamoyl group; and wherein $R_3$ and $R_4$ each represent a hydrogen atom or an alkyl group.

2. The desensitizing solution of claim 1, wherein said polyether polyamine has a colloid equivalent value of not lower than 3 at a pH between 3 and 10.

3. The desensitizing solution of claim 1, wherein said polyether polyamine is a compound in which k is an integer of from 1 to 60, m is an integer of 1 to 12, x is an integer of 1 to 5, y is an integer of 1 to 10 and $R_1$ is a hydrogen atom or $C_nH_{2n}R_2$ having 1 to 8 carbon atoms.

4. The desensitizing solution of claim 1, wherein said polyether polyamine is a compound in which k is from 2 to 50, and m is from 1 to 10.

5. The desensitizing solution of claim 1, wherein said polyether polyamine is a compound in which an x to y ratio (x:y) is from 1:1 to 4:1.

6. The desensitizing solution of claim 1, wherein said polyether polyamine has a number average molecular weight of from 100 to 1,000,000.

7. The desensitizing solution of claim 1, wherein said phytic acid or a salt thereof is in a concentration of from 1 to 200 g/l and said polyether polyamine is in a concentration of from 0.01 to 20 g/l.

8. The desensitizing solution of claim 1, wherein said solvent is water.

9. A desensitizing solution for lithographic platemaking, comprising an aqueous solvent:

phytic acid or a salt thereof; and a polyamine derivative represented by the formula:

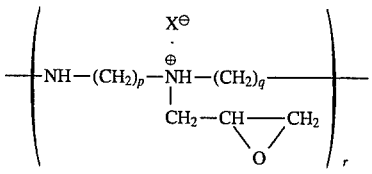

(II)

wherein X represents a halogen atom; p and q each represent an integer of from 2 to 6; and r represents an integer of from 3 to 2000.

10. The desensitizing solution of claim 9, wherein said polyamine derivative has a colloid equivalent value of not lower than 3 at a pH between 3 and 10.

11. The desensitizing solution of claim 9, wherein p and q are each 2 to 3 and X is a chlorine atom.

12. The desensitizing solution of claim 9, wherein said polyamine derivative has a number average molecular weight of from about 1000 to 1,000,000.

13. The desensitizing solution of claim 9, wherein said phytic acid or a salt thereof is in a concentration of from 1 to 200 g/l and said polyamine derivative is in a concentration of from 0.01 to 20 g/l.

14. The desensitizing solution of claim 9, wherein said solvent is water.

* * * * *